United States Patent [19]

Manspeaker

[11] Patent Number: 4,640,509

[45] Date of Patent: Feb. 3, 1987

[54] BALANCE GAME

[76] Inventor: Edward L. Manspeaker, 483 Exton Lake Rd., Apollo, Pa. 15613-9214

[21] Appl. No.: 731,917

[22] Filed: May 8, 1985

[51] Int. Cl.[4] ..... A63F 9/00

[52] U.S. Cl. ..... 273/1 GF

[58] Field of Search ..... 273/1 GF; 177/190

[56] References Cited

U.S. PATENT DOCUMENTS

| | | | |
|---|---|---|---|
| 3,188,089 | 6/1965 | Odell et al. | 273/1 GF X |
| 3,761,084 | 9/1973 | Dieckmann | 273/1 R |
| 3,764,134 | 10/1973 | Reinerteen | 273/1 R |
| 3,774,908 | 11/1973 | Greenberg | 273/1 R |
| 3,784,196 | 1/1974 | Berlin | 273/1 E |
| 3,809,396 | 5/1974 | Leight et al. | 273/1 R |
| 3,829,096 | 8/1974 | Gioia et al. | 273/110 |
| 3,940,129 | 2/1976 | Franco | 273/1 R |
| 3,960,376 | 6/1976 | Berlin | 273/1 E |
| 4,200,292 | 4/1980 | Slimp, Jr. | 273/19 GF X |
| 4,293,128 | 10/1981 | Ebel | 273/1 GF |
| 4,354,682 | 10/1982 | Veala | 273/153 R |
| 4,358,110 | 11/1982 | Youkstetter | 273/1 GC |

*Primary Examiner*—Paul E. Shapiro

*Attorney, Agent, or Firm*—William D. Lanyi

[57] ABSTRACT

A balance skill game utilizes a plurality of levers and fulcrums in association with weights that are shaped to be received in support relation on the levers. The fulcrums are shaped to receive a lever in balance support relation thereon and to receive one end of a lever into a groove or recess shaped in the base portions of the fulcrums. By carefully assembling the levers and fulcrums together, a complex structure can be assembled in which all but one of the fulcrums are supported by levers that are, in turn, supported by other fulcrums. The assembly of fulcrums and levers can be constructed in which only one fulcrum is required to support a plurality of other fulcrums and levers above a playing surface, such as a table top.

16 Claims, 12 Drawing Figures

BALANCE GAME

BACKGROUND AND SUMMARY OF THE INVENTION

The present invention relates generally to games of skill and, more particularly, to a balance skill game that utilizes a plurality of levers, fulcrums and weights.

Many types of games are known to those skilled in the art in which the game provides a test of balance skill that can be used as a source of competition between players or teams, as an individual achievement game or as a learning game. U.S. Pat. No. 4,293,128, which issued on Oct. 6, 1981 to Ebel, discloses a center-of-gravity appraisal game in the form of a set of gauge indicia-marked parallelepiped blocks for stacking by players or teams in alternating turns until the stack tumbles. Certain proportions of the blocks used in that game are substantially critical for balancing purposes. The blocks are shaped with particular angles and dimensions and the game is played until an imbalance causes the structure of blocks to tumble, thus designating the player represented in the previous turn as being the winner.

U.S. Pat. No. 3,761,084, which issued on Sept. 25, 1973 to Dieckmann, discloses a balance board game that includes a freely rotating and tiltable standing platform of appropriate size to allow two persons to stand upright thereon. A plurality of numbered stepping blocks are rotatably secured to the upper surface of the platform and cards for selecting two of the rotating blocks, to be occupied by the feet of each player, are provided. This game involves the balancing of two human bodies on the platform and on the specific rotating blocks indicated by the cards.

U.S. Pat. No. 3,774,908, which issued on Nov. 27, 1973 to Greenberg, discloses a balance toy that includes a balance arm that is pivotable about a horizontal axis. A metal bell is secured to and covers the projecting end of a horizontal shaft and a pair of clappers include weights that are secured to the free ends of a pair of flexible elongated wire springs. As one side of the balance arm is rotated downwardly, the wire spring rides along the incline surface of the support member cam and is pushed off the member of the balance arm cam. The bias of the wire spring causes it to snap outwardly and thus drive the weight against the bell causing it to ring. Pivotal movement of the balance arm is caused by placing one or more chips or weights on the ends of the arm, the number of chips placed on the arm being determined by a spinner mechanism.

U.S. Pat. No. 3,809,396, which issued on May 7, 1974 to Leicht et al. discloses a balance game that includes a pivoted balance beam having marble support members pivotally connected thereto at its opposite end portions. The support members are guided for vertical movement and adapted to support a plurality of objects, such as marbles. The marbles are held in containers operatively associated with the balance beam. The containers have a plurality of apertures formed therein in spaced positions with respect to each other so that when an imbalance occurs in the balance beam the beam begins to pivot. When the beam pivots, the ends of the support members are moved to positions against the apertures in the container and the marbles are caused to fall from the containers.

U.S. Pat. No. 3,940,129, which issued on Feb. 24, 1976 to Franco, discloses a game of balance that can be used as a party game for two players, Each of the players wear a foam rubber or plastic headband in which each player stands on his or her own circular disc. Each of the players tries to push his opponent out of the opponent's circle with his hands tied behind his back by pushing his headband against his opponent's headband.

U.S. Pat. Nos. 3,784,196 and 3,960,376, which issued on Jan. 8, 1974 and June 1, 1976, respectively, to Berlin, disclose a balancing skill game that includes an elongated substantially cylindrical toy simulating the head end portion of a snake including a throat portion, flanges and head having a base member opposite the head. The toy is adapted to be balanced in an upright position on the palm of a players hand. An electrical circuit, with lamps and a source of electrical energy, is contained within the toy. A plurality of mercury switches are located in the body of the toy and are connected in series between the source of electrical energy and the lamps. If the toy is caused to tilt beyond a certain acceptable point, the mercury switches open and deactivate the time delay circuits and lamps.

U.S. Pat. No. 3,829,096, which issued on Aug. 13, 1974 to Gioia et al., discloses a balanced maze game apparatus that comprises a game board which is supported on a flexible rod and associated base member. Upstanding flanges define a maze path on the game board surface through which a ball may roll. A plurality of depressions are provided about the periphery of the game board and weights removably positioned in these depressions adjustably tip the game board on its flexible rod support causing the ball to roll through the maze path responsive to the selected position of the weights.

U.S. Pat. No. 4,358,110, which issued on Nov. 9, 1982 to Youkstetter, discloses a balance game apparatus that provides a game of skill and strategy wherein weighted elements are placed on extending arms attached to a central balancing portion supported above a column. The weights must be carefully distributed so that the arms do not lean too far in one direction so as to close an electrical circuit and actuate a signal device. A battery is located within the central column and a signal device such as a light is mounted atop the central portion to detect closing of the electrical circuit and the player's errant attempt to balance the device. Dice are rolled to determine on which of the depending arms the weighted elements must be hung. Scores are awarded for balancing the weights towards the ends of the extending arms in relation to the position on the arms at which the weights are balanced.

U.S. Pat. No. 3,764,134, which issued on Oct. 9, 1973 to Reinerteen, discloses a game that includes a playing platform affixed to one end of a stiff spring. The other end of the spring is affixed to a base. During the play of the game, the contestants are directed by a chance mechanism, as by cards drawn from a pack, to deposit or remove playing pieces from the balanced platform. The platform has a plurality of playing piece receiving pockets which are interconnected at a point above the point of connection of the platform to the spring. The playing pieces are free to move from one pocket to another and the play of the game continues until the platform becomes unbalanced and the playing pieces are dumped from the platform onto the base.

U.S. Pat. No. 4,354,682, which issued on Oct. 19, 1982 to Veala discloses a twelve coin balancing puzzle in which a total of thirteen identical appearing coins is provided in lieu of the usual twelve coins. Eleven of these thirteen coins are made identical in weight to result in eleven identical coins and two remaining coins. One of the remaining coins is heavier than any one of the eleven identical coins and the other of the remaining coins is lighter. These two remaining coins are undistinguishable from the eleven identical coins without some sort of aid to the human senses. Such an aid is provided to enable separation of the two remaining coins from the eleven identical coins when they are all mixed together at the start of the game. One of the two remaining coins can then be added to the eleven coins to make up the necessary twelve coins to work the puzzle. The player does ont known whether a lighter or heavier coin has been added and thus a new and challenging game is presented each time.

Balancing games are popular because they presented game playing challenges that involve both physical and tactical skills. The present invention provides a balance game that comprises a plurality of boards, or levers, and a plurality of fulcrums. When boards are used as levers in the present invention, each of the boards comprises two generally parallel planar surfaces. Each of the planar surfaces has a length and a width. The planar surfaces are shaped to receive one or more weights in support relation thereon. When boards are used as levers, the weights can be shaped with each individual weight having two generally parallel circular planar surfaces. This type of disc shape is similar to that of a coin and permits the weights to be easily stacked on the upper surface of the lever or on top of each other.

The fulcrums of the present invention provide a support portion which is shaped to receive one of the levers in balance support relation thereon. In alternative embodiments of the present invention, the support portion of each fulcrum can be a generally flat surface that provides two pivot edges at its opposite sides, a curved surface or a structure shaped to provide two generally parallel pivot edges at a preselected distance from each other. Each fulcrum has a base portion which provides stable support for the fulcrum and its lever on a playing surface, such as a table top. The base portion of each fulcrum is located at the bottom portion of the fulcrum. A groove is provided in the base portion of the fulcrum to receive a portion of a lever therein. By disposing a portion of a lever in the groove of the fulcrum's base, the fulcrum can be lifted above the playing surface in support relation on the lever. By successively performing the above described procedure, an assembly of levers and fulcrums can be constructed in which the assembly is supported by a single fulcrum. In such a construction, a plurality of levers and fulcrums can be combined in a balance assembly with only one of the fulcrums being in contact with the playing surface. In a preferred embodiment of the present invention, the assembly of fulcrums and levers can also be supported by disposing one end of a lever under the bottom surface of another lever to lift the other lever without the need for placing the first lever under a fulcrum as described above. Each time a new lever is inserted under the support fulcrum or the bottom lever of the assembly, the entire existing assembly is lifted away from the playing surface by the newly added lever. Since each new lever must lift all preceding levers and fulcrums, each succeeding step of the game becomes more difficult and requires increased balance and tactical skills.

The present invention can be used as a game of skill in which one player attempts to achieve an assembly construction comprising as many levers as possible without causing the structure to collapse because of an imbalance. The present invention also provides a game in which two or more players can compete against each other during the construction of the fulcrum and lever assembly. By successively adding levers to the structure, each player raises the existing assembly with the additional lever, thus making it more difficult for the other player or players to add a subsequent lever.

The present invention provides a game that involves both balance ability and tactical skill. Furthermore, it provides a unique learning game in which the players acquire knowledge and experience relating to the laws of mechanics, levers and fulcrums, moments and moment arms.

BRIEF DESCRIPTION OF THE DRAWING

The present invention will be more fully understood from a reading of the description of the preferred embodiment in conjunction with the drawing, in which.

DESCRIPTION OF THE PREFERRED EMBODIMENT

Figure 1:
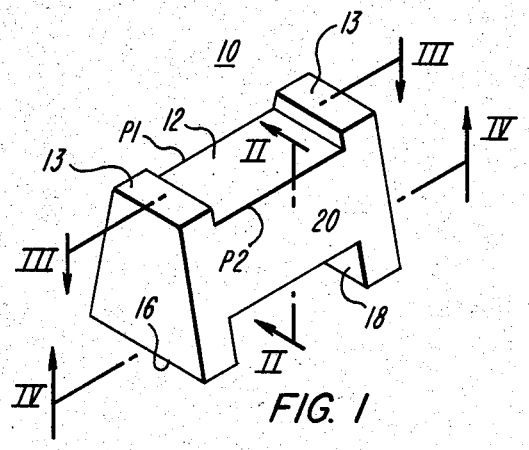
FIG. 1 is a sectioned view of a fulcrum of the present invention.

The present invention is a game of balance and tactical skill which permits the players to successively construct a plurality of lever and fulcrum assemblies. Each lever and fulcrum assembly is subsequently lifted in balance relation by another lever and fulcrum. During each stage of assembly, all previously assembled lever and fulcrum combinations are lifted away from a playing surface and supported by a single fulcrum which is in contact with the support surface, such as a table top.

The present invention utilizes a fulcrum 10 which is shaped to provide a support portion 12 and a base portion 14 which has a base surface 16. When the base surface 16 is placed on a generally flat playing surface, such as a table top, it provide stable support for the fulcrum 10 and disposes the support portion 12 in a generally horizontal configuration parallel to the surface of the table top. The base portion 14 is also provided with a groove 18 that is shaped to receive one end of a lever (reference numerals 32 or 34 of FIG. 5) at a position beneath the support portion 12. The fulcrum 10 of the present invention can be made of any suitable material, such as wood or plastic, and can further be provided with lobes 13 that serve as an aid in retaining a lever in alignment with the support portion 12. Although the support portion 12 is illustrated as a generally flat surface in FIG. 1, it should be understood that the present invention is operable with alternative types of support portions. For example, the functional importance of the support portion 12 is that it provides two generally parallel pivot edges, P1 and P2, on which a lever can be disposed in balance support relation. Any structure which provides these type of edges can be used in accordance with the present invention even though no surface exists therebetween. Alternatively, the support portion 12, which is illustrated as a flat surface in FIG. 1, can be a curved surface with a sufficiently large radius of curvature to permit a lever, or board, to be balanced thereon with the scope of human balance skills.

Figure 1A:
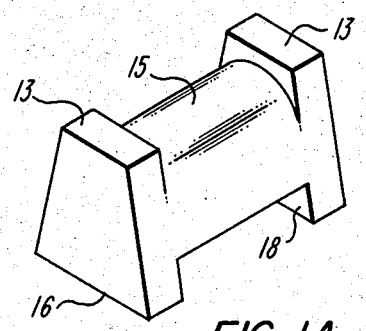
FIG. 1A illustrates a fulcrum with a rounded support portion.

As discussed above, the support portion 12 does not have to be a flat surface. In one alternative embodiment of the present invention, the support portion 12 comprises a curved surface 15 as illustrated in FIG. 1A. The curved surface 15 is disposed between the lobes 13 and has a radius of curvature that is sufficiently large to permit a player with reasonable skill to balance a lever thereon. For example, the fulcrum in FIG. 1A has a radius of curvature that permits the surface 15 to blend smoothly into the sloping sides of the fulcrum. When a fulcrum such as that illustrated in FIG. 1A is used in conjunction with the present invention, a lever that is disposed on the curved surface 15 is balanced on an effective edge defined by the contact portion between the curved surface 15 and the lever. As the weights are disposed on the lever, this effective edge can move as the lever tilts in relation to the fulcrum. Since there is very little slipping action between the lever and the curved surface 15, this moving effective edge, defined by the contact line between the lever and the curved surface 15, shifts in response to the changing angles of tilt of the lever. This shifting tends to reduce the moment arm of the heavier portion of the lever and, therefore, tends to achieve an equilibrium balance point. However, the potential shifting of this effective edge is limited and significant balance skills are still required on the part of the player. It should be understood that, although three alternative embodiments of the support portion 12 have been discussed and two alternative embodiments have been illustrated, many alternative embodiments for the support portion 12 are within the scope of the present invention. FIG. 1 illustrates a generally flat support portion 12, FIG. 1A illustrates a curved surface 15 used as the support portion and, in the discussion above, a support portion comprising two edges was described. The precise shape of the support portion of the fulcrum 10 is not critical to the proper operation of the present invention. The only requirement of the support portion 12 is that it provides some means to balance a lever within the reasonable skills of an average player of the game.

Figure 2:
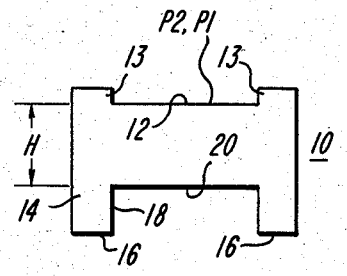
FIG. 2 is a side view of the fulcrum of FIG. 1.
Figure 3:
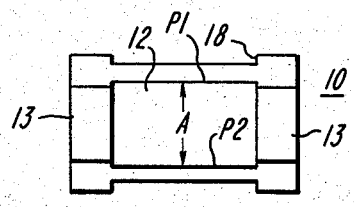
FIG. 3 is a top view of the fulcrum of FIG. 1.

FIG. 2 illustrates a side view of the fulcrum 10 of FIG. 1. The side view of the fulcrum 10 illustrates the support portion 12, the lobes 13, the groove 18 and the base portion 14 with its base surface 16. The groove 18 is shaped to receive a portion of a lever under the fulcrum 10 for purposes of lifting the fulcrum 10 away from the playing surface, such as a table top, and for supporting the fulcrum 10 in balance relation on the inserted lever. The support portion 12 can be a generally flat surface, as illustrated in FIGS. 1, 2 and 3, shaped to receive a lever that is placed upon it. As will be described in greater detail below, a game can be played with the present invention in which a lever is disposed on the support portion 12 and balanced with one or more weights placed on top of the lever. After balancing this first lever on a first fulcrum 10, a second lever can be disposed with one of its ends placed within the recess, or groove 18, of the first fulcrum 10. By placing a second fulcrum in supporting relation beneath the second lever, weights can be added to an opposite end of the second lever for purposes of lifting the first fulcrum up from the playing surface. After the second lever is placed in balance relation on the second fulcrum, an assembly is created in which the first and second levers, along with the first fulcrum, are supported by the second fulcrum. As the game continues, one portion of a third lever would be extended into the recess, or groove 18, of the second fulcrum and, using a third fulcrum, weights would be placed at the other end of the third lever for the purposes of supporting the entire assembly in balance relation on the third fulcrum. As each new lever is inserted under the support fulcrum of the lever-fulcrum assembly, the new lever is used to lift the entire previously assembled number of levers and fulcrums away from the playing surface. Therefore, each additional lever provides an increased level of difficulty compared with previously added levers. As the game progresses, the participating player of the game must either utilize significantly larger amounts of weight or significantly longer moment arms provided by the newly added lever. The participating player must tactically determine the relative advantages of using a lever arm that is longer than those previously used, disposing the new fulcrum at a position much closer to the existing assembly than to the weighted end of the new lever or utilize a significant number of weights to lift the existing lever fulcrum assembly off of the fulcrum that is presently acting as the main support fulcrum for the assembly.

The fulcrum 10 illustrated in FIG. 2 illustrates a distance, or height H, between the support surface 12 and an upper surface 20 in the groove 18. It has been discovered that this relative height H is important to the proper construction of the fulcrum 10. If the height H is too great, the playing of the game is made too difficult because of the excessive height that results as a plurality of fulcrums and levers are assembled together. Conversely, if the height H is too small, the playing of the game is made too easy because of the excessive stability that results.

In a preferred embodiment of the present invention, the height H which is illustrated in FIG. 2 is generally equal to the dimension A illustrated in FIG. 3, which is a top view of the fulcrum 10 of FIG. 1. As will be described below, the dimension A represents the length of the support portion 12, between edges P1 and P2, that is intended for use with an associated lever that is placed upon it. As the support portion length A is increased, the game becomes easier to play because of the increased amount of stability that is provided by the increased distance between the edges, P1 and P2, of the support portion 12. Conversely, as the support portion length A is made smaller (i.e. edges P1 and P2 are made closer together), the game becomes increasingly difficult. As an extreme example, if the support portion length A is made infinitesimally small, such as in a knife edge support with edges P1 and P2 coincident, the game would become virtually impossible to play because of the extreme level of balancing skill that would therefore be required.

Figure 4:
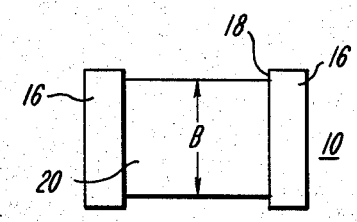
FIG. 4 is a bottom view of the fulcrum of FIG. 1.

FIG. 4 illustrates a bottom view of the fulcrum 10 of FIG. 1. The groove length B is another variable which can affect the difficulty of the game. Since the upper surface 20 of the groove 18 provides a contact surface between the fulcrum 10 and a supporting lever, an increase in the groove length B makes the game easier to play and a decrease in the groove length B makes the game more difficult to play. In a preferred embodiment of the present invention, it has been found that a ratio of groove length B to support portion length A of approximately 1.5 provides a satisfactory balance game which requires skill on the part of the players but is not excessively difficult so as to prevent the successful assembly of a plurality of fulcrum and lever combinations by a relatively skilled player. Although many specific dimensions can be used in accordance with the present invention, one particular embodiment of the present invention has been constructed and successfully used which employs the following dimensions: Height H is one half inch (0.5"), support portion length A is one half inch (0.5") and groove length B is three-fourths of an inch (0.75"). Although the upper surface 20 of the groove 18 is illustrated in FIG. 4 as a generally flat surface, it should be understood that this is not a requirement of the present invention. The only functional requirement of the upper surface 20 is that it provides two generally parallel edges under which a portion of a lever can be disposed. In FIG. 4, these edges are generally parallel and dispose a distance B apart from each other and each edge extends between the two opposing legs that provide the support surfaces 16 in FIG. 4.

Figure 5:
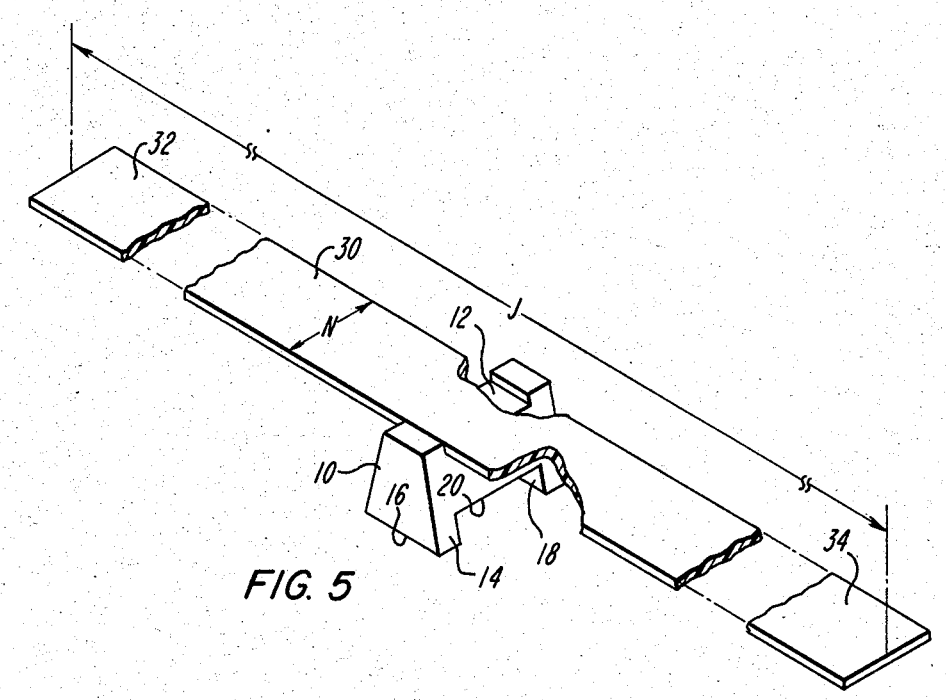
FIG. 5 is a perspective view showing the fulcrum of the present invention associated in support relation with a lever board.

FIG. 5 illustrates the fulcrum 10 of the present invention associated with a lever 30. The lever 30 has a length, or major dimension J, and a width, or minor dimension N. The minor dimension N is chosen to permit the lever 30 to fit above the support portion 12, between the two upper lobes 13 of the fulcrum 10, in clearance relation. The major dimension J can be of any size that is determined to be suitable for play. In a preferred embodiment of the present invention, the present invention comprises a plurality of levers 30 in which the individual levers 30 have different major dimensions J. It has been found that a diverse plurality of levers 30, with an assortment of different major dimensions J, provide an additional tactical element to the playing of the game in which advantage can be gained by judiciously selecting levers 30 with appropriate major dimensions J. During a typical game, the shorter levers are normally used during the early stage of building the lever fulcrum assembly and the longer levers are used later in the game. As described above, each new lever that is added to the assembly must lift all preceding levers and fulcrums of the existing assembly away from the playing surfaces so that the entire assembly is supported and balanced on only one fulcrum, the fulcrum that has been added last. In choosing these levers to be added to the assembly, the player is presented with various tactical options. For example, the player may choose a relatively short lever and add a large amount of weight to its free end to provide lifting force that is sufficient to lift the existing assembly away from the playing surface. Alternatively, the player may choose a very long fulcrum and use less weight. Furthermore, the location where the added fulcrum is disposed relative to the length J of the lever will determine the relative moment arms of the added lever. By placing the new fulcrum very close to the existing lever fulcrum assembly, the player can decrease the amount of weights required to lift the assembly.

The lever 30 in FIG. 5 is shown having a first end portion 32 and a second end portion 34. It should be noted that the groove 18, or recess, of the fulcrum 10 is shaped to receive either one of the these end portions of the lever 30 within and through it. This size selection permits a player to insert one portion of a lever 30 into the groove 18 and thereby lift the fulcrum 10 away from the playing surface by exerting an upward force against the upper surface 20 of the groove 18. This capability allows the player to form an additional fulcrum-lever combination in which one end of the lever is used to support another fulcrum lever combination in balance relation thereon. By successively performing this procedure with additional fulcrums and levers, the player can construct an assembly which comprises a large number of fulcrums and levers in which the entire assembly is supported by only one fulcrum which is in contact with the playing surface, such as a table top.

Figure 6:
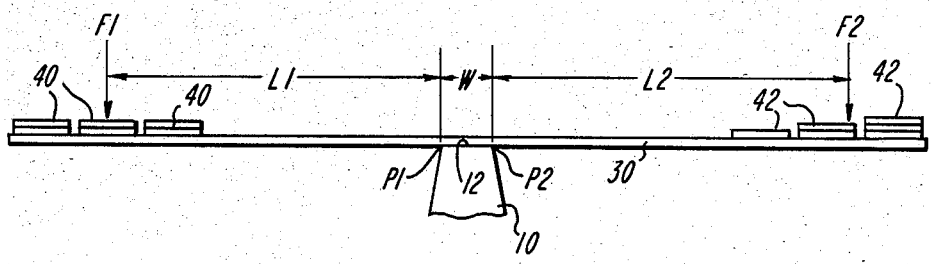
FIG. 6 is a schematic illustration of the balance principles related to the present invention.

FIG. 6 illustrates a schematic diagram that demonstrates the basic mechanics that are involved during the playing of the game in which a lever 30 is supported, in balance relation, on a support portion 12 of a fulcrum 10. It should be noted that, in FIG. 6, the fulcrum 10 is illustrated in a simplified form without upper lobes 13 and without a base portion for purposes of illustrating the mathematical and physical relationships that are used by the present invention to facilitate the playing of the game.

In order to describe the pertinent mechanical relationships of the present invention, two groups of weights, 40 and 42, are shown disposed in support relation on the upper surface of a lever 30. Although, in the described preferred embodiment of the present invention, all of the weights are equal in weight, alternative embodiments of the present invention could use individual weights which differ from each other. For example, the present invention can be used in association with a number of coins. If identical weights are to be used, one particular type of coin, such as a nickel, can be used. However, if different weights of coins are desirable, different types of coins, such as nickels, dimes, pennies, quarters, etc., can be used with the present invention. All alternative sizes and shapes of weights should be considered to be within the scope of the present invention.

The side view of the present invention, illustrated in FIG. 6, shows two force vectors which represent the downward force caused by each group of weights. Force vector F1 is provided by weights 40 and passes through the center of gravity of that group of weights. Force vector F2 represents the force provided by the weights 42 and passes through the center of gravity of those weights. It should be understood that, regardless of the number or specific location of the weigths, effective force vectors can be represented as passing through their respective centers of gravity.

The support portion 12 is shown in FIG. 6 as having two points, P1 and P2, defining its length. It should be understood that these points P1 and P2, are actually end views of two opposite edges of the support portion 12 as illustrated in FIGS. 1, 2 and 3. As described above, the distance between P1 and P2 (reference numeral A in FIG. 3) determines the difficulty of the game. This length is indicated in FIG. 6 by reference numeral W. It should be understood that reference numeral W of FIG.

6 and reference numeral A of FIG. 3 represent the same length (i.e. the distance between edges P1 and P2).

As weights are added to, or taken from, the upper surface of the lever 30, the lever 30 can be caused to achieve an imbalance in either a direction coincident with force vector F1 or force vector F2. If weights 40 are increased substantially, force F1 will become sufficient to cause the lever 30 to rotate about point P1 and fall off the support portion 12. Conversely, if sufficient weights 42 are provided, force F2 can be increased sufficiently to cause the lever 30 to rotate about P2 and fall off the support portion 12. Either of these two conditions will cause a failure in an attempt to achieve a balanced structure during the playing of the game. Therefore, it is in the interest of the layer to provide a combination of forces, F1 and F2, in conjunction with lever arms L1 and L2, that are within acceptable limits to provide a proper balance of the lever 30 on top of the support surface 12. This relationship of forces and moment arms can be expresed mathematically.

The relationship of forces and moment arms which will cause the lever 30 to begin to rotate about point P1 are illustrated in equation (1).

$$F1\times(L1)>F2\times(L2+W) \quad (1)$$

If the product of F1 and L1 is greater than the product of F2 and (L2+W), the lever 30 will rotate about point P1 in a direction indicated by force vector F1 and the lever 30 will fall from the fulcrum 10. Similarly, the weights can be placed on the fulcrum 30 in such a way to cause the fulcrum 30 to rotate about point P2 and fall from the support portion 12 in a direction indicated by force vector F2. This relationship is described in equation (2).

$$F1\times(L1+W)<F2\times(L2) \quad (2)$$

Therefore, if the product of F2 and L2 is greater than the product of F1 and (L1+W), the fulcrum 30 will rotate about point P2 in a direction represented by force vector F2 and the lever 30 will fall from the support portion 12. Either of these two imbalance situations, represented by equations (1) and (2), will cause the lever 30 to fail to achieve proper balance on the support portion 12 of the fulcrum 10 and will represent a failure of the player's attempt to assemble a fulcrum-lever combination.

From the above discussion, it should be apparent that length W provides a margin of error that facilitates the balancing procedure. As an illustration, if a force F1 is provided that is less than or equal to F2 times (L2+W) divided by L1 and greater than or equal to (F2×L2) divided by (L1+W), a proper balancing will be achieved.

In forming a fulcrum-lever combination, the player must exhibit balance skills in determining the quantity of weights and their relative positions on the upper surface of the lever 30. It should be understood that, according to the basic laws of mechanisms, different combinations of weights and moment arms form alternative configuratins that provide the same moment about any selected point. In other words, lesser amounts of weight are required if they are placed further from the fulcrum 10 than would be required if they were placed closer to the fulcrum 10.

Figure 7:
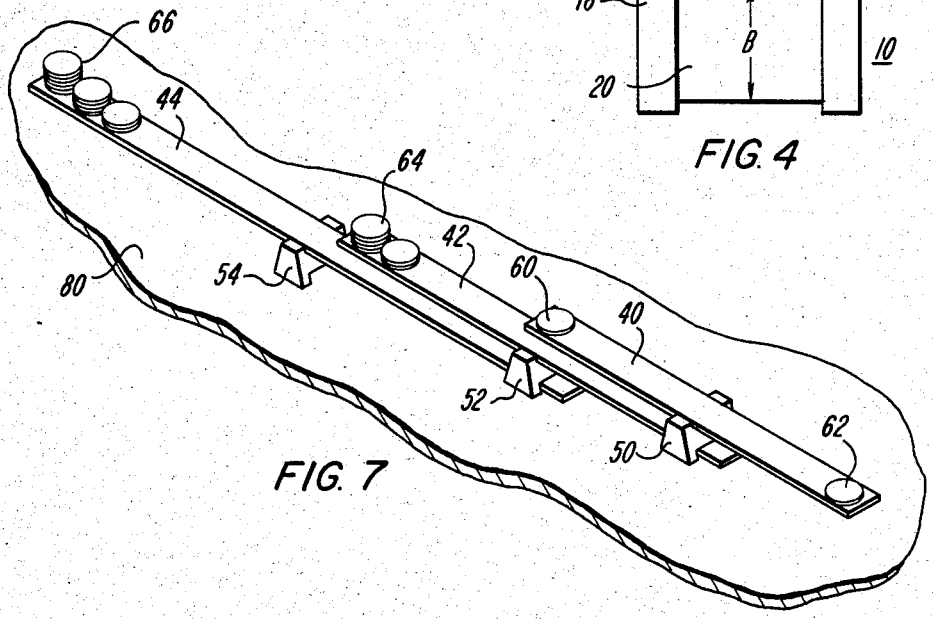
FIG. 7 is a perspective view of the present invention illustrating an initial stage of assembly.
Figure 8:
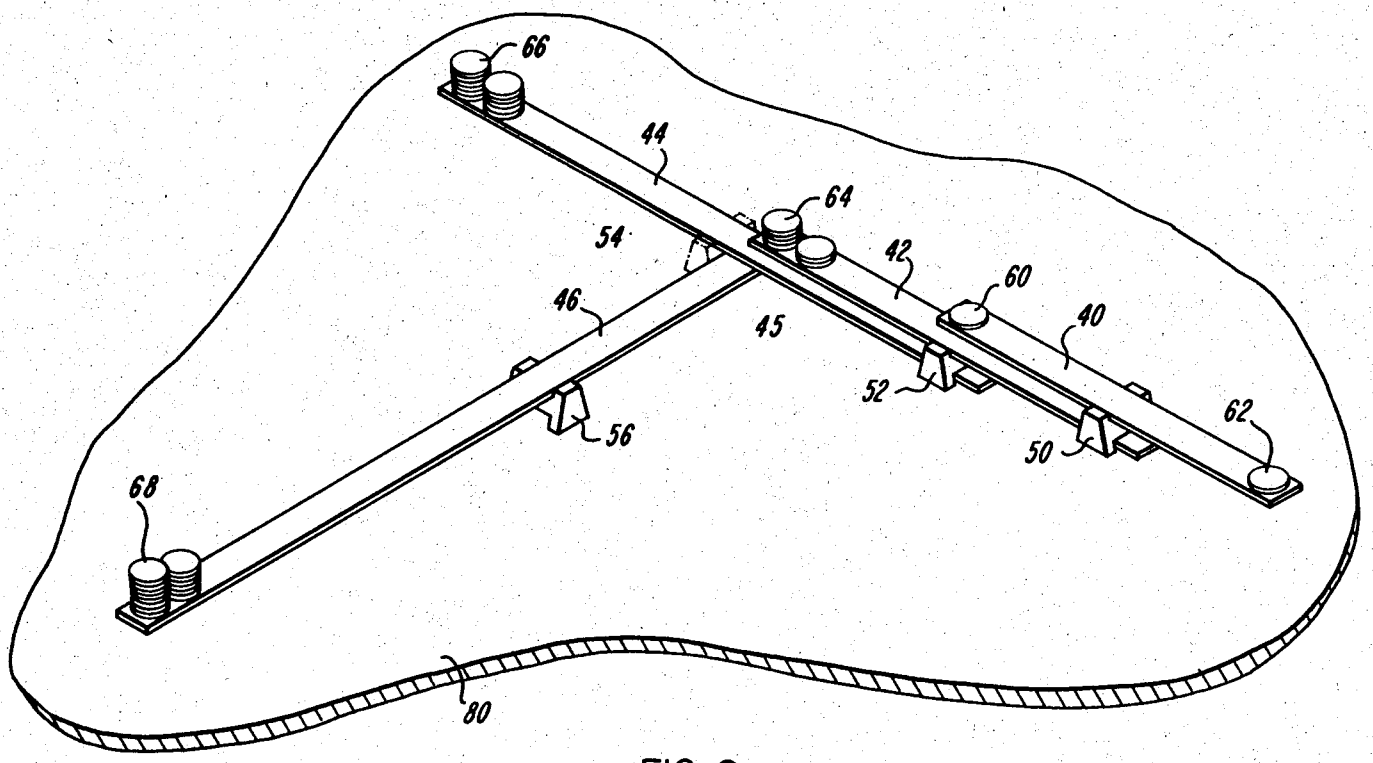
FIG. 8 is a perspective view of the present invention illustrating a stage of assembly which would occur later than the stage illustrated in FIG. 7.
Figure 9:
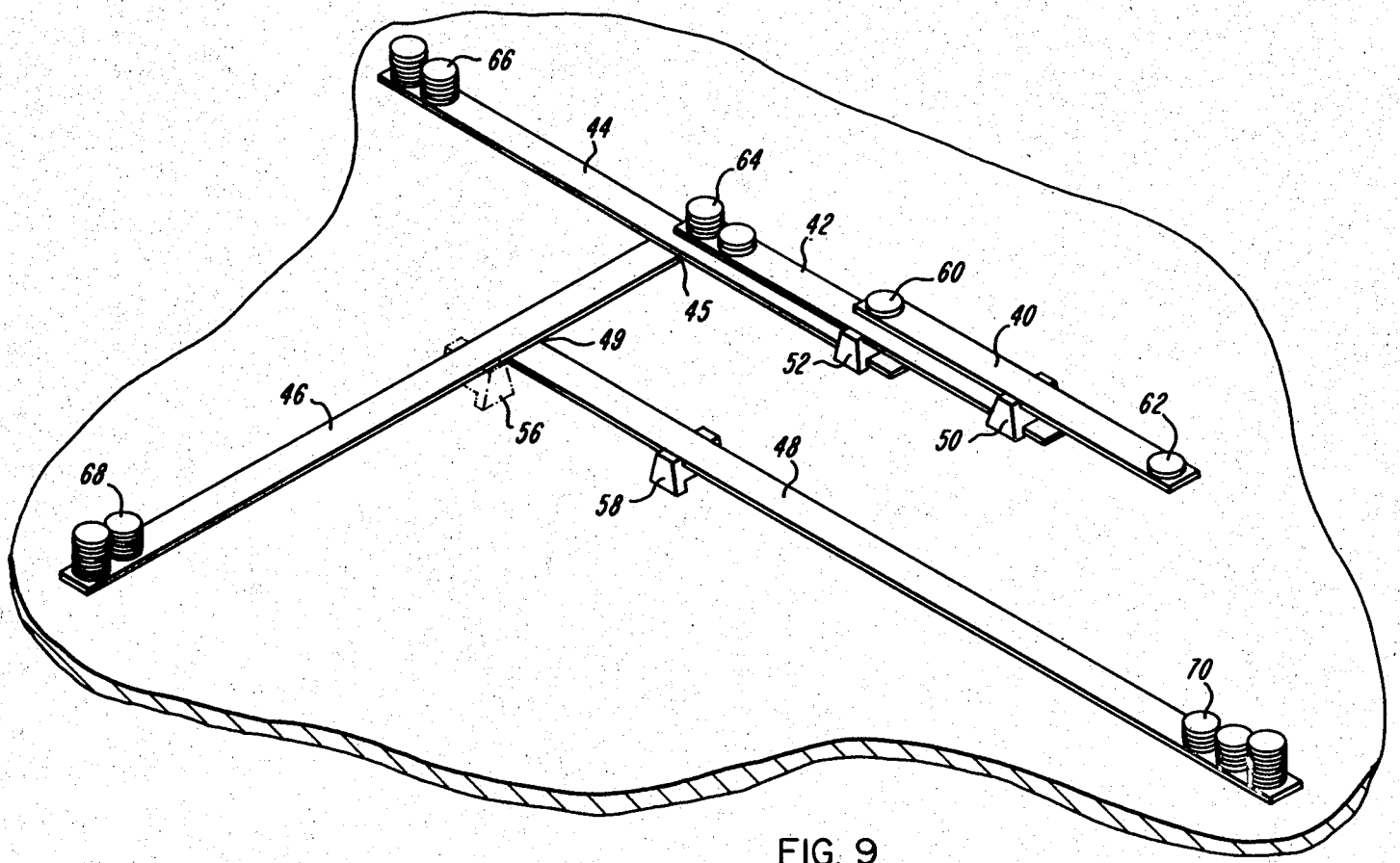
FIG. 9 is a perspective view of the present invention illustrating a stage of assembly that would logically follow the assembly stage illustrated in FIG. 8.

FIGS. 7, 8 and 9 illustrate exemplary assemblies of fulcrums and levers as they would appear in successive stages of construction during a hypothetical playing of the game. The assembly shown in FIG. 7 comprises three levers, 40, 42 and 44, associated with three fulcrums, 50, 52 and 54. It should be understood that, to arrive at the asembly shown in FIG. 7, the first lever 40 was first balanced on fulcrum 50 by adding groups of weights 60 and 62. During this initial phase of construction, fulcrum 50 rested on the playing surface 80. The next step in construction consisted of the insertion of one portion of lever 42 into the groove in the base portion of fulcrum 50. By adding weights 64 to the opposite end of the lever 42, fulcrum 50 and lever 40 were raised above the playing surface 80 and supported solely by fulcrum 52.

The next step in construction consisted of placing one portion of lever 44 into the groove in the base portion of fulcrum 52. Then, by properly placing a group of weights 66 on the other end of the lever 44, fulcrums 50 and 52 and levers 40 and 42 were raised from the playing surface 80 and the entire assemby is supported only by fulcrum 54, which remains in contact with the playing surface 80. The above described procedure resulted in the fulcrum-lever assembly illustrated in FIG. 7.

Figure 7A:
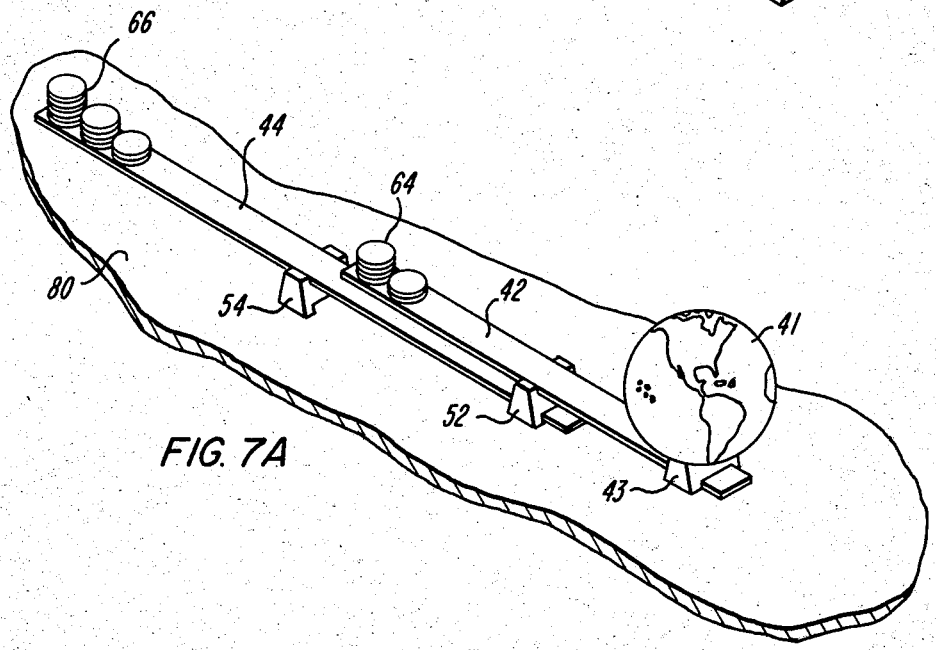
FIG. 7A illustrates an embodiment of the present invention that utilizes a model world globe to begin play.

As described above, the assembly illustrated in FIG. 7 was begun by balancing lever 40 on fulcrum 50 with weights 60 and 62 propoerly disposed on top of lever 40. In an alternative embodiment of the present invention, the game is begun by placing a small model on the playing surface and the first step of the game is lift that model away from the playing surface by using a lever and fulcrum. This alternative concept is illustrated in FIG. 7A. In this particular embodiment of the present invention, the model is a simulation of the earth 41 that is rigidly attached to a base portion 43. The base portion 43 of the model is similar in construction to the fulcrums described above. It is provided with a groove through which a portion of a lever can be disposed for purposes of exerting a lifting force on the model 41 that lifts it away from the playing surface 80. The particular embodiment illustrated in FIG. 7A is similar to that illustrated in FIG. 7, but with the model 41 of the earth replacing fulcrum 50, lever 40 and weights 60 and 62 as the beginning operation of the game. By comparing FIGS. 7 and 7A, it can be seen that all other components at this stage of the game are identical. Therefore, it should be understood that in the discussion below. relating to FIGS. 8 and 9, the model 41 could replace fulcrum 50, lever 40 and weights 60 and 62 in both the illustrations and the discussion.

After completion of the assembly illustrated in FIG. 7, another lever 46 is disposed with one of its ends placed under lever 44. This construction step is illustrated in FIG. 8. In combination with fulcrum 56, lever 46 can be used to provide an upward force against the bottom planar surface of lever 44, at point 45. By adding a group of weights 68 on top of the other end of lever 46, sufficient leverage can be provided to lift lever 44 above fulcrum 54, which is illustrated by phantom lines in FIG. 8. When sufficient upward force is provided by lever 46 to lift lever 44 above fulcrum 54, fulcrum 54 can be removed from the assembly since it is no longer required to support levers 44, 42 and 40 along with their associated fulcrums 52 and 50. At the stage of construction illustrated in FIG. 8, the entire assembly is supported by fulcrum 56 which is disposed in support relation on the playing surface 80. It should be clearly understood that the insertion of each new additional lever requires that that lever lift all previous fulcrums and levers in the assembly. This makes the game progressively more difficult as each new lever is added. For example, when lever 44 has disposed beneath fulcrum 52, weights 66 were required to provide a sufficient upward force against fulcrum 52 to lift fulcrums 50 and 52, levers 40 and 42 weights 60, 62 and 64. However, when lever 46 was disposed under lever 44, weights 68 had to provide sufficient force to lift fulcrums 50 and 52, levers 40, 42 and 44 and weights 60, 62, 64 and 66. This illustrates the progressively increasing difficultly during each successive step of the game. This increasing difficulty also illustrates the purpose for providing a plurality of levers having different lengths. For example, lever 46 in FIG. 8 is longer than the previously assembled levers. As the game progresses, longer levers can be used to provide sufficient moment arms so that excessive amounts of weights (e.g. weights 68 in FIG. 8) are not required to lift the entire previously assembled structure.

It should be noted that the step of construction that is illustrated in FIG. 8 differs slightly from the previous steps of construction described in conjunction with FIG. 7. Lever 46 was disposed in direct contact with lever 44, at point 45, instead of beneath a fulcrum. This tactic permits a player to create an assembly with the levers disposed at angles relative to each other which are generally perpendicular. For example, lever 46 is generally perpendicular to lever 44 whereas levers 40, 42 and 44 are generally parallel to each other. An alternative method for achieving this perpendicular association of levers would be to provide crossed grooves in the bases of the fulcrum.

FIG. 9 illustrates a stage of assembly that would be subsequent to the assembly stage illustrated in FIG. 8. As shown in FIG. 9, lever 48 is disposed with one of its ends under lever 46, at point 49. In association with fulcrum 58, lever 48 can be used to provide a lifting force beneath lever 46 by adding a group of weights 70 on top of the upper surface of lever 48 at its other end. As sufficient weights 70 are added, the upward force on lever 46 at point 49 is sufficient to lift lever 46 off its fulcrum 56 which is illustrated by phantom lines in FIG. 9. When this occurs, fulcrum 56 can be removed and, along with fulcrum 54 (shown by phantom lines in FIG. 8), is no longer needed. At the stage of assembly illustrated in FIG. 9, the entire construction of fulcrums and levers is supported by a single fulcrum 58 which rests on the playing surface 80. It should be apparent that a subsequent stage of construction would consist of placing another lever with one of its ends under lever 48 at a point between fulcrum 58 and point 49 or of placing one of its ends into the groove in the base portion of fulcrum 58. Either alternative tactic is possible during the playing of the game with the present invention. By using an additional fulcrum, weights can be provided by an opposite end of the additional lever to provide a lifting force under lever 48 and raising the entire assembly off of fulcrum 58. By carefully adding levers and fulcrums under the levers or fulcrums of the existing assembly, additional levers and fulcrums can be incorporated into the overall structure as the game progresses and the structure enlarges.

Figure 10:
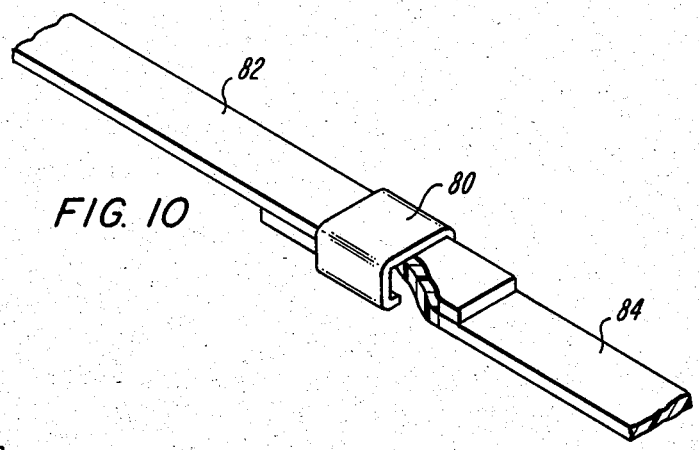
FIG. 10 shows a clip adapter that permits two levers to be attached together.

As the game progresses, the combined weight of all the fulcrums, levers and weights in the existing assembly progressively increases. Therefore, it may become necessary to adapt new levers to increase their length for the purposes of providing sufficiently long lever arms to lift the existing assembly. In an alternative embodiment of the present invention, an adapter has been used to combine two or more lever arms so that their effective length can be increased. FIG. 10 illustrates this adapter. The adapter 80 is shaped to receive two levers, 82 and 84, within its structure. By placing the two levers together within the adapter 80, the combined ends of the levers can be attached together for purposes of creating an effective lever that is almost twice the combined lengths of the two levers, 82 and 84, that are attached together in this manner. The adapter 80 is illustrated in FIG. 10 as being a plate that is bent to define an essentially rectangular inner opening that is sized to receive two levers therein simultaneously. Alternatively, the adapter 80 could be one or more stiff wires shaped to extend around the combined lever assembly.

As described above, the players of the game have the option of lifting the existing fulcrum-lever assembly off the playing surface 80 by employing either of two alternative techniques. The first technique involves the placement of one end of a lever into the groove in the base portion of the main support fulcrum. This procedure is described above in relation to FIG. 7. The alternative technique involves the placement of one end of a lever under the bottom surface of the main support lever that is disposed on the support surface of the main support fulcrum which is supported directly by the playing surface. This procedure is described in relation to levers 46 and 48 in FIGS. 8 and 9, respectively. These alternative techniques provide tactical options for the players.

The present invention provides a balance skill game which can be played according to various different sets of rules. It can accommodate a skill game played by only one player or a competitive game in which competing players take alternative turns during the assembly of a lever and fulcrum structure. When only one player is playing the game, the goal of the game can be to seen how many levers can be combined in a structure before the structure collapses due to imbalance caused by the player's error. In this mode of playing, a second player can later also attempt to construct an assembly that employs a greater number of levers than the assembly of the first player.

Under alternative game playing rules, competing players can take successive turns during the construction of the single fulcrum and lever assembly. For example, referring to FIGS. 7, 8 and 9, the first player would construct a simple lever and fulcrum combination comprising of lever 40 and fulcrum 50 with groups of weights 60 and 62. The second player would add lever 42 and fulcrum 50, along with weights 64, to the structure. The next player (e.g. the first player if only two players are involved in the game) would then add lever 44 and fulcrum 54, along with weights 66 to further expand the structure. The next player would add lever 46 and fulcrum 56 along with weights 68. At this point in the game, the player who added lever 46 successfully to the assembly would remove fulcrum 54. As shown in FIG. 9, the next player would add lever 48 and fulcrum 58 to the assembly with weights 70 and would remove fulcrum 56 from the structure. The unsuccessful player who causes the structure to collapse would lose the game.

It should be understood that alternative sets of rules could be provided in which points are awarded for fulcrums that are removed from the structure, such as fulcrums 54 and 56 in FIGS. 8 and 9, respectively. An added challenge could be provided by assigning a specific limited number of weights to each player so as to force each player to economize the use of weights during the construction of the assembly.

In a preferred embodiment of the present invention, the weights are shaped to resemble a coin, such as a nickel. Although alternative shapes of weights can be used, it has been found that weights having two generally parallel and circular planar surfaces are especially suited for use with the levers of the present invention. These disc-shaped weights permit stacking and stable disposal on the upper surfaces of the levers. Furthermore, the use of coins permits the players to provide their own weights instead of being limited to the weights provided with the game as originally purchased.

The present invention provides a game of balance skill that can be played by one or more players. Besides testing the balancing skills of the players, the present invention also provides a learning game in which the players learn the basic principles of mechanics involving levers and fulcrums and the principles of moments and moment arms. Although the present invention has been described with particular specificity, it should be understood that alternative embodiments of the present invention should be considered within its scope. Furthermore, although hypothetical sets of exemplary rules are described herein, many different game playing rules can be used in accordance with the present invention.

What I claim is:

1. A balance game, comprising:

a plurality of levers, each of said plurality of levers being shaped to receive one or more weights in support relation thereon;

a plurality of fulcrums, each of said fulcrums having a base portion and a support portion, said support portion being generally shaped to receive one of said plurality of levers in support relation thereon; and whereby a first one of said plurality of levers can be disposed on said support portion with one or more of said weights disposed in support relation on said first lever, said first lever being balanced on said support portion, said base portion being disposed on a playing surface, said base portion having a recess disposed therein, said recess being shaped to receive a portion of a preselected one of said plurality of levers.

2. The balance game of claim 1, wherein:

said plurality of levers comprises individual levers with different lengths.

3. The balance game of claim 1, wherein:

each of said levers is a board having two generally parallel planar surfaces.

4. A skill game, comprising:

a plurality of boards, each of said plurality of boards having two generally parallel planar surfaces, each of said planar surfaces having a length and a width; and a plurality of fulcrums, each of said fulcrums having a base portion and a support portion, said support portion providing two generally parallel edges disposed a preselected distance apart to receive one of said plurality of boards in support relation when said board is disposed on top of said support portion, said base portion being shaped to receive a portion of one of said plurality of boards under said base portion, said base portion being provided with a groove disposed between two support legs, said groove being shaped to receive said portion of said board in clearance relation.

5. The game of claim 4, further comprising:

a plurality of weights, each of said plurality of weights being shaped to be disposed on an upper one of said two planar surfaces of said board.

6. The game of claim 5, wherein:

each of said plurality of weights has two generally parallel and generally circular planar surfaces.

7. The game of claim 5, wherein:

a first one of said plurality of boards is disposable in balance relation on said support portion of a first one of said plurality of fulcrums with a preselected number of said plurality of weights disposed on one end of said first board and a preselected number of said plurality of weights disposed on the other end of said first board with one end of a second one of said plurality of boards disposed in said groove under said first fulcrum.

8. The game of claim 4, wherein:

each of said plurality of boards is made of wood.

9. The game of claim 4, wherein:

each of said plurality of boards is made of plastic.

10. A balance game, comprising:

a plurality of fulcrums, each of said plurality of fulcrums having a support portion and a base portion; and a plurality of levers, each of said levers being shaped to be recieved in balanced support relation on said support portion, said base portion of said fulcrum having a groove shaped to receive one portion of a preselected one of said plurality of levers under said fulcrum, said groove being disposed between two leg portions of said base portion, each of said plurality of levers being shaped to receive a plurality of weights in support relation thereon.

11. The game of claim 10, further comprising:

a plurality of weights shaped to be disposed on said plurality of levers.

12. The game of claim 11, wherein:

each of said weights has a planar surface.

13. The game of claim 10, wherein:

each of said levers is made of wood.

14. The game of claim 10, wherein:

each of said levers is made of plastic.

15. The game of claim 10, wherein:

each of said fulcrums is made of wood.

16. The game of claim 10, wherein:

each of said fulcrums is made of plastic.

* * * * *